US007148188B2

(12) United States Patent
Lawrence et al.

(10) Patent No.: US 7,148,188 B2
(45) Date of Patent: Dec. 12, 2006

(54) BOTTLEWASH ADDITIVE COMPRISING AN ALKYL DIPHENYLENE OXIDE DISULFONATE

(75) Inventors: Michel Lawrence, Inver Grove Heights, MN (US); Gerald Wichmann, Maple Grove, MN (US)

(73) Assignee: Ecolab Inc., Eagan, MN (US)

( * ) Notice: Subject to any disclaimer, the term of this patent is extended or adjusted under 35 U.S.C. 154(b) by 256 days.

(21) Appl. No.: 10/664,265

(22) Filed: Sep. 17, 2003

(65) Prior Publication Data

US 2005/0037939 A1 Feb. 17, 2005

Related U.S. Application Data

(60) Provisional application No. 60/411,937, filed on Sep. 18, 2002.

(51) Int. Cl.
*C11D 1/22* (2006.01)
*C11D 1/722* (2006.01)
*C11D 1/83* (2006.01)

(52) U.S. Cl. ..... 510/243; 510/174; 510/220; 510/356; 510/421; 510/426; 510/428; 510/495

(58) Field of Classification Search ..... 510/243, 510/174, 220, 356, 421, 426, 428, 495
See application file for complete search history.

(56) References Cited

U.S. PATENT DOCUMENTS

| | | | | | |
|---|---|---|---|---|---|
| 3,625,904 | A | * | 12/1971 | Nosler et al. | 510/377 |
| 4,014,806 | A | * | 3/1977 | Connor et al. | 510/429 |
| 4,069,933 | A | | 1/1978 | Newing | 215/12.2 |
| 4,081,395 | A | * | 3/1978 | Talley | 510/219 |
| 4,624,803 | A | * | 11/1986 | Balzer et al. | 510/219 |
| 5,009,801 | A | | 4/1991 | Wilder et al. | 252/33.2 |
| 5,073,280 | A | | 12/1991 | Rossio et al. | 252/49.3 |
| 5,223,162 | A | * | 6/1993 | Rossio | 508/179 |
| 5,295,601 | A | | 3/1994 | Bostelman | 220/287 |
| 5,352,376 | A | | 10/1994 | Gutzmann | 508/216 |
| 5,391,308 | A | | 2/1995 | Despo | 508/164 |
| 5,441,654 | A | | 8/1995 | Rossio | 252/49.3 |
| 5,474,692 | A | | 12/1995 | Laufenberg et al. | 508/500 |
| 5,559,087 | A | | 9/1996 | Halsrud et al. | 508/579 |
| 5,723,418 | A | | 3/1998 | Person Hei et al. | 508/511 |
| 5,770,555 | A | * | 6/1998 | Weinstein | 510/434 |
| 5,849,095 | A | | 12/1998 | Rouillard | 134/3 |
| 5,972,866 | A | * | 10/1999 | Ahmed | 510/218 |
| 6,036,789 | A | * | 3/2000 | Weibel | 134/42 |
| 6,090,860 | A | * | 7/2000 | Peters et al. | 521/148 |
| 6,106,633 | A | | 8/2000 | Rouillard | 134/3 |
| 6,168,808 | B1 | * | 1/2001 | Hamon Godin et al. | 424/616 |
| 6,207,622 | B1 | | 3/2001 | Li et al. | 508/208 |
| 6,214,777 | B1 | | 4/2001 | Li et al. | 508/388 |
| 6,247,478 | B1 | * | 6/2001 | Cords et al. | 134/22.1 |
| 6,372,698 | B1 | | 4/2002 | Strothoff et al. | 508/459 |
| 6,427,826 | B1 | | 8/2002 | Li et al. | 198/500 |
| 6,436,893 | B1 | | 8/2002 | Lentsch et al. | 510/446 |
| 6,485,794 | B1 | | 11/2002 | Li et al. | 427/512 |
| 6,495,494 | B1 | | 12/2002 | Li et al. | 508/206 |
| 6,530,386 | B1 | * | 3/2003 | Bragulla et al. | 134/25.4 |
| 6,537,960 | B1 | * | 3/2003 | Ruhr et al. | 510/423 |
| 6,554,005 | B1 | * | 4/2003 | Cords et al. | 134/22.1 |
| 6,599,584 | B1 | | 7/2003 | Plester et al. | 427/488 |
| 6,673,753 | B1 | | 1/2004 | Person Hei et al. | 508/208 |
| 6,835,702 | B1 | * | 12/2004 | Herdt et al. | 510/219 |
| 6,838,422 | B1 | * | 1/2005 | Man et al. | 510/243 |
| 2003/0050203 | A1 | | 3/2003 | Herdt et al. | 510/180 |

FOREIGN PATENT DOCUMENTS

| | | | |
|---|---|---|---|
| DE | 10035780 | | 2/2002 |
| EP | 0 844 301 | | 5/1998 |
| EP | 844301 | * | 5/1998 |
| GB | 2 314 563 | | 1/1998 |
| WO | 97/34711 | | 9/1997 |
| WO | 98/22566 | | 5/1998 |
| WO | 02/12422 | | 2/2002 |

* cited by examiner

*Primary Examiner*—Charles Boyer
(74) *Attorney, Agent, or Firm*—Kinney & Lange, P.A.

(57) ABSTRACT

An alkaline bottlewashing concentrate effective for removal of mold and for protecting polyethylene terephthalate containers including at least one cleaning/protecting surfactant which is a $C_4$ to $C_{20}$ alkyl diphenylene oxide disulfonate, an ethoxylated alcohol sulfonate, an alkyl polyether phosphate ester, an aryl polyether phosphate ester, an alkylaryl polyether phosphate ester, a polycarboxylated ethylene oxide condensate of a fatty alcohol, or a mixture thereof. The cleaning composition is compatible with polyethylene terephthalate.

6 Claims, 1 Drawing Sheet

BOTTLEWASH ADDITIVE COMPRISING AN ALKYL DIPHENYLENE OXIDE DISULFONATE

CROSS-REFERENCE TO RELATED APPLICATIONS

This application claims the benefit of U.S. Provisional Patent Application Ser. No. 60/411,937, filed on Sep. 18, 2002, which is incorporated by reference herein in its entirety.

FIELD OF THE INVENTION

The invention relates generally to plastics compatible detergent compositions and methods for cleaning plastics, in particular for compositions and method for cleaning polyethylene terephthalate containers. Some compositions are particularly effective for removal of mold from polyethylene terephthalate containers.

BACKGROUND OF THE INVENTION

Plastic containers have become more popular in the beverage bottling industry in recent years for a variety of reasons. Plastic containers are lighter weight and reduce freight costs. When they are dropped on hard surfaces they do not shatter like glass, and typically do not break. They also tend to cause less wear and tear on the conveyors employed in bottling and packaging plants. Furthermore, both bottle and closures are typically reusable, but closures are typically not reused in bottling plants, but only by the consumer Plastic containers may be made from any number of materials depending on the application. One material is polyethylene terephthalate, "PET". Two types of PET bottles that are commonly used are single trip and multi-trip bottles. Single trip bottles are those which are filled, used, and then discarded. Multi-trip or refillable (REF-PET) bottles are collected and reused and must be washed before refilling.

REF-PET bottles generally cost more than glass containers. Recycling of PET containers was recently approved by the FDA in the US to permit turning used containers into new ones making the use of PET even more attractive. Thus, recycling used bottles has become economically attractive.

Single trip bottles are cut up and the pieces must be washed before the PET plastic is melted for molding new bottles. The cut up pieces are then washed with chemicals that do not corrode the plastic. In time, glass soft drink bottles are expected to disappear from the market. This heightens the relevance of PET container processing even further.

Cleaning of PET can be difficult, however, and one serious problem which occurs with returnable reusable PET bottles is mold, particularly in warmer climates. Rejection rates of 40–50% have occurred at certain times of the year in countries located in tropical climates. Discarding all of the bottles from which mold cannot be removed can thus be prohibitively expensive. Therefore, it is desirable to clean the PET bottles, rather than discard them.

The cleaning of PET bottles takes place over a series of steps using caustic immersion tanks and spray wash stages in a bottlewasher. In the wash tanks, product residue, dirt, labels and labeling adhesive are removed.

There are several problems associated with the cleaning of PET bottles because they cannot be washed like glass bottles. For one thing, because the surface of PET bottles is hydrophobic, cleaning them is more difficult than glass bottles. Also, the lower washing temperature decreases the chemical activity of the bottle washing solution. While glass bottles are normally washed at 80° C., PET bottles must be washed at lower temperatures of about 60° C. due to the glass transition temperature of PET. At temperatures higher than 60° C., the PET can deform and shrink. The cleaning power of a bottlewashing solution at 60° C., however, is only one quarter that at 80° C. This compounds the problem of trying to eliminate mold, as well as other microbiological forms of life such as bacteria, spores, and yeasts, for example, from the returned bottles. Bottles returned with product residue, i.e., those bottles that have not been rinsed, are almost always contaminated with microbiological forms of life.

A further problem in the cleaning of returnable PET bottles is that PET, unlike glass, has difficulty withstanding relatively high concentrations of caustic. While glass may be washed with up to 5.0% caustic, as little as 0.1 to 0.2 wt-% caustic may cause corrosion. However, concentrations of less than about 1.5% caustic are typically not practical for cleaning. Thus, when PET articles are washed for recycling and reuse, however, it is typically a more highly caustic detergent composition that is used to remove old labels and to clean and sterilize the interior of the articles because lower concentrations tend to be less effective at attacking and removing soil.

Highly caustic solutions can also cause what is referred to in the industry as "stress cracks" in the PET. Highly caustic solutions tend to attack and degrade PET which can lead to "stress cracks" within, or even completely through the walls of the articles over repeated washing cycles, or even within a single washing cycle. Conventional caustic bottle washing compositions often also contain other constituents which have a deleterious effect on PET.

Indeed, it has long been known that exposure by such articles to these compositions leads to these phenomenon which has been identified as "stress cracking" in these PET containers and other such articles of manufacture. "A general surface attack can result in "fogging" of the normally transparent PET material. This is a result of chemical etching of the surface of the PET container by the caustic present in the wash bath and is commonly referred to in the industry as "hazing".

As noted, conventional aqueous-based bottlewashing compositions containing caustics, alcohols, nonionic surfactants and/or other additives do not inhibit or prevent stress cracking in such containers, but rather, promote stress cracking.

Stress cracking can cause loss of carbonation pressure and ultimately can result in product loss from the container. Stress cracking may further lead to bottles which break. This can result in downtime for cleaning. Furthermore, when cases are stacked, other bottles can become sticky from the spilled beverage, in the case of sodas, for example.

Thus, with glass, the washing temperature, the caustic concentration, and the washing time may be adjusted to allow for variability within the environment in contrast to PET containers which cannot withstand high levels of any of these variables.

While various alternatives have been proposed such as lowering the level of caustic, there remains a need in the industry for compositions and methods which allow for the efficient cleaning of PET containers and multiple reuse events.

SUMMARY OF THE INVENTION

The present invention relates to a bottlewashing additive for the removal of mold which is compatible with polyethylene terephthalate (PET), REF-PET and glass.

In one aspect, the present invention relates to an additive which may be employed in a cleaning composition, particularly alkaline cleaning compositions employed in bottlewashing applications. The additive is effective for removal of mold and for protecting polyethylene terephthalate containers.

The additive includes at least one cleaning/protecting surfactant which is a $C_6$ alkyl diphenylene oxide disulfonate, an ethoxylated alcohol sulfonate, an alkyl polyether phosphate ester, an aryl polyether phosphate ester, an alkylaryl polyether phosphate ester, a polycarboxylated ethylene oxide condensate of a fatty alcohol (oxyalkylated linear alcohol carboxylic acid adduct), an alkamide, or mixture thereof. The cleaning composition is compatible with and does not cause corrosion or hazing of polyethylene terephthalate containers. The surfactants may be employed in amounts of about 1 wt-% to about 20 wt-%, more suitably about 2 wt-% to about 10 wt-%, and most suitably about 5 wt-%.

The surfactants are suitably employed in combination with at least one sequestrant. In some embodiments, at least one first sequestrant is a phosphonate sequestrant, and suitably the phosphonate sequestrant is employed in combination with a second sequestrant which is a phosphate sequestrant, a phosphonate seuqestrant or a mixture thereof.

Other sequestrants may also be employed such as gluconic acid, citric acid, lactic acid, and salts thereof. In one embodiment according to the present invention, a gluconate, suitably an alkali metal gluconate, such as sodium gluconate, is employed in combination with phosphonates.

Suitably, a defoamer is employed in combination with the surfactant/sequestrant. In one embodiment, the defoamer is a block copolymer of polyoxyethylene/polyoxypropylene.

In another aspect, the present invention relates to an additive for an alkaline cleaning concentrate, diluted prior to use, for cleaning and protecting polyethylene terephthalate containers, particularly for removal of mold on polyethylene terephthalate containers without corroding or hazing of the containers. The composition includes at least one $C_4$ to $C_{20}$ alkyl diphenylene oxide disulfonate, at least one first sequestrant which is a phosphonate sequestrant and at least one second sequestrant which is a phosphate sequestrant, a phosphonate sequestrant or a mixture thereof. Suitably, the alkyl diphenylene oxide disulfonate is a $C_6$ to $C_{16}$ alkyl diphenylene oxide disulfonate, and most suitably the alkyl diphenylene oxide disulfonate is a $C_6$ diphenylene oxide disulfonate. In some embodiments, a $C_6$, a $C_{12}$ and a $C_{16}$ alkyl diphenylene oxide disulfonate were employed.

Other sequestrants may be employed in combination with the surfactant/sequestrant system including, for example, gluconic acid, citric acid, lactic acid, and so forth, and salts thereof.

Suitably a defoamer is employed in the additive for the alkaline cleaning concentrate. In one embodiment, the defoamer is a block copolymer of polyoxyethylene/polyoxypropylene.

In some embodiments wherein mold is not a factor, the surfactants employed may include at least one ether carboxylate, at least one ethoxylated alcohol sulfonate, at least one alkamide, at least one polycarboxylated ethylene oxide condensate of a fatty alcohol, at least one alkyl polyether sulfonate, at least one alkyl polyether phosphate, at least one aryl polyether phosphate, at least one alkylaryl polyether phosphate, or mixture thereof.

Again, the surfactants may be employed in combination with the sequestrants and/or defoamers, as well as others not described above.

As described herein, the surfactants may be employed in the additives and alkaline cleaning concentrates in amounts from about 1 wt-% to about 20 wt-%, more suitably about 2 wt-% to about 10 wt-%, and most suitably about 5 wt-% of the concentrate.

Suitably, for bottlewashing compositions, the surfactants described above are employed in combination with at least one sequestrant. Suitably, at least one sequestrant is a phosphonate. In some embodiments, the present inventors have found the most superior cleaning and protecting properties when at least one first sequestrant which is a phosphonate sequestrant is employed, and more suitably the first sequestrant is employed in combination with at least one second sequestrant which is a phosphate sequestrant, a phosphonate sequestrant or a mixture thereof.

Other sequestrants may also be employed such as gluconic acid, citric acid, lactic acid, and salts thereof. In one embodiment, a gluconate, suitably an alkali metal gluconate such as sodium gluconate, is employed in combination with the phosphonates.

Suitably a defoamer is employed in combination with the surfactant/sequestrant. In one embodiment, the defoamer employed is a block copolymer of polyoxyethylene/polyoxypropylene.

In another aspect, the present invention also relates to a method of cleaning polyethylene terephthalate containers including the steps of contacting the containers with any of the compositions described above. It is important also that the compositions employed for cleaning be compatible with PET, i.e. do not show stress corrosion cracking or hazing of the PET containers. When selecting the surfactant, this is of high importance. In some embodiments, the cleaning includes mold removal. For other applications, mold removal may not be a factor.

The compositions according to the present invention are non-corrosive, i.e. non-hazing, to polyethylene terephthalate (PET), particularly refillable PET and are excellent for the removal of mold. Of course, such compositions may also be employed on glass.

The compositions are also excellent for the removal of labels, particularly those that are adhesively applied and have been exposed to the sun. Adhesively applied labels, after sun exposure, can be extremely difficult to remove.

The compositions of the present invention can be employed for single use recyclable PET articles, as well as for multiple use refillable PET containers. In the former case, the method includes the steps of cutting the PET articles into smaller pieces such as strips, washing the cut-up PET pieces with the compositions according to the present invention, melting the cut-up, washed PET pieces, and reforming them into new articles.

DETAILED DESCRIPTION OF THE PREFERRED EMBODIMENTS

Figure 1:
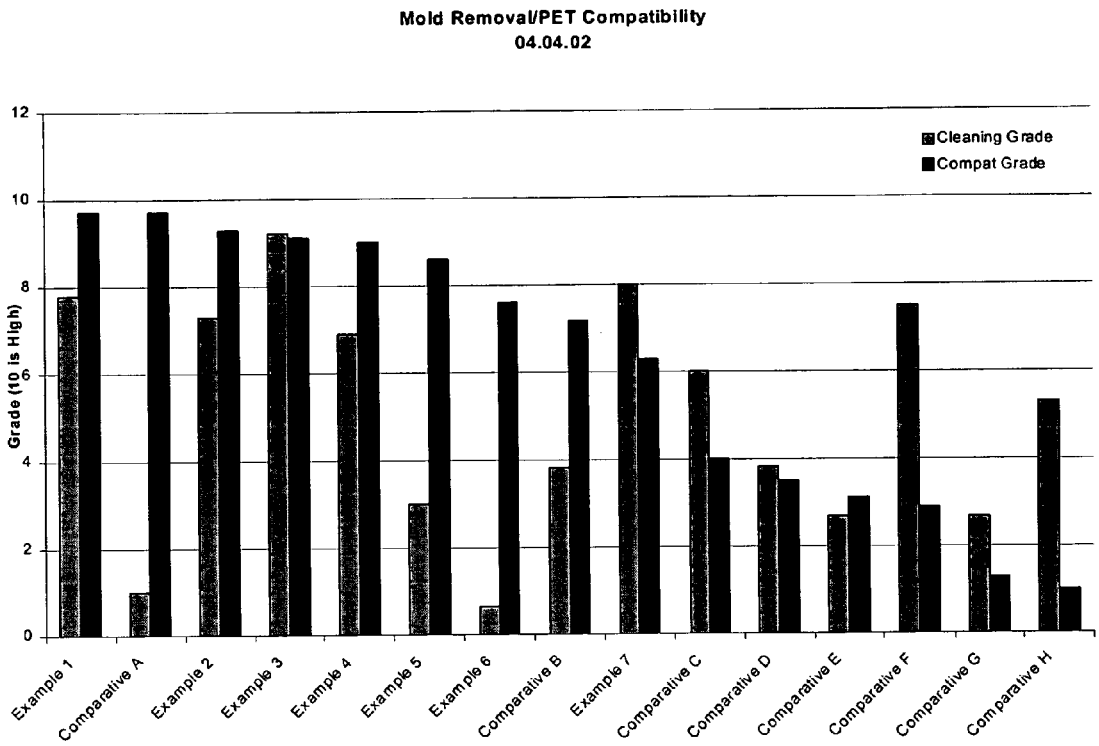
FIG. 1 is a summary of the cleaning/protecting test results for a variety of surfactants tested in a base composition.

While this invention may be embodied in many different forms, there are described in detail herein specific embodiments of the invention. This description is an exemplification of the principles of the invention and is not intended to limit the invention to the particular embodiments illustrated.

The present invention, in a first aspect, provides an additive for an alkaline cleaning composition, particularly for the removal of mold, and for the protection of polyethylene terephthalate (PET) containers.

In another aspect, the present invention relates to a method of cleaning/protecting PET containers by contacting the containers with the compositions according to the present invention.

In some aspects, wherein mold removal is not a factor, the compositions may be employed as protectants for PET containers.

The compositions are particularly suitable for bottlewashing applications.

As used herein, the phrase "applied color design" refers to a design, decoration, decorative element, or label that is applied in a fashion which is intended to be permanent while the article, for example a bottle, is in circulation, use, and/or reuse. One type of applied color design is referred to herein as an "applied color label" (ACL). An applied color label is a label that is applied in a fashion which is intended to be permanent while the article, e.g. bottle, is in circulation, use and/or reuse.

1. The Surfactants

It is desirable for most applications, to employ a surfactant which exhibits superior cleaning properties, including mold removal, as well as one which is compatible for use on polyethylene terephthalate containers. By the latter, it is meant that the surfactants act as a protectant in that the containers do not exhibit corrosion or hazing from the alkaline cleaning composition. While highly alkaline compositions are useful for cleaning glass, they tend to cause corrosion and hazing when used on polyethylene terephthalate. However, effective cleaning is almost impossible without some alkalinity. Thus, the surfactants employed herein desirably act to protect the polyethylene terephthalate.

Examples of detersive/mold removal surfactants which are compatible for use on polyethylene terephthalate include, but are not limited to, the $C_4$ to $C_{20}$ sodium alkyl diphenylene oxide disulfonates, ethoxylated alcohol sulfonates, alkyl polyether phosphate esters, aryl polyether phosphate esters, alkylaryl polyether phosphate esters, polycarboxylated ethylene oxide condensates of fatty alcohols, alkamides, and mixtures thereof.

The alkyl diphenylene oxide disulfonates useful herein include those having an alkyl group with about 4 to about 20 carbon atoms, and more suitably about 6 to about 16 carbon atoms. In one preferred embodiment, the alkyl diphenylene oxide disulfonate employed was a $C_6$ alkyl diphenylene oxide disulfonate. This alkyl diphenylene oxide disulfonate was found to exhibit superior cleaning/mold removal characteristics, as well as suitably protecting the polyethylene terephthalate containers from corrosion or hazing in the alkaline bottlewashing environment. In other embodiments, the alkyl diphenylene oxide disulfonates employed included a $C_{12}$ and a $C_{16}$ alkyl diphenylene oxide disulfonate.

Examples of commercially available surfactants suitable for use herein include, for example, DOWFAX® C6L, a $C_6$ alkyl diphenylene oxide disulfonate, DOWFAX® 2A1, a $C_{12}$ alkyl diphenylene oxide disulfonate, DOWFAX® 8390, a $C_{16}$ alkyl diphenylene oxide disulfonate, all available from Dow Chemical Co.; POLYTERGENT® CS-1, a polycarboxylated ethylene oxide condensate of a fatty alcohol available from BASF; AVANEL® S74, a sodium linear alkylpolyether sulfonate available from BASF; alkyl polyether phosphate esters such as ETHOX® 3036 available from Ethox Chemicals, LLC in Greenville, S.C., T-MULZ 800 available from Harcros Organics, MONAFAX® 831 alkyl polyether phosphate available from Mona Industries, Inc. in Paterson, N.J. OR RHODAFAC® RA-600 (linear ethoxylate phosphate ester) available from Rhodia in Cranbury, N.J.; alkylaryl polyether phosphate esters such as RHODAFAC® RP-710 (nonylphenol ethoxylate phosphate ester) available from Rhodia in Cranbury N.J., RHODAFAC® RE-610 (nonylphenol ethoxylate phosphate ester) available from Rhodia (GAFAC® RE-610 from Rhone-Poulenc) and SOPROPHOR® 3D-33 (tristyrylphenol ethoxylate phosphate ester) available from Rhone-Poulenc; Alkamide DC212 S coconut diethanolamide available from Rhodia; and so forth.

Other surfactants were found to clean or protect, but not to both effectively clean and protect PET from corroding or hazing.

Short chain alkyl benzene sulfonates were found to be ineffective for both cleaning and for protecting PET articles. For example, sodium xylene sulfonate and sodium cumene sulfonate were found to be ineffective as protectants and the containers exhibited corrosion or hazing. Sodium napthalene sulfonates exhibited effective protection, but did not effectively clean the containers. The longer chain alkyl benzene sulfonates were more effective for protecting and cleaning, but were found to produce too much foam for use in a commercial bottlewashing operation.

In applications where mold is not a factor, the surfactants employed may include at least one ether carboxylate, at least one alkamide, at least one polycarboxylated ethylene oxide condensate of a fatty alcohol, at least one alkyl polyether sulfonate, at least one alkyl polyether phosphate ester, at least one aryl polyether phosphate ester, at least one alkylaryl polyether phosphate ester, or mixture thereof.

Commercially available representatives include, for example, SANDOPAN® DTC acid, an ether carboxylate available from Clariant Corp.; Alkamide DC212 S, a coconut diethanolamide available from Rhodia; POLYTERGENT® CS-1, a polycarboxylated ethylene oxide condensate of a fatty alcohol available from BASF; AVANEL® S74, a sodium linear alkypolyether sulfonate available from BASF; and so forth.

Additionally, the cleaning compositions of the present invention may be made safe for use on polyethylene terephthalate, i.e. "PET" containers. For embodiments in which the containers to be cleaned are polyethylene terephthalate, then the surfactant selected may be a sodium alkyl diphenylene oxide disulfonate, an ethoxylated alcohol sulfonate, an alkyl polyether phosphate ester, an aryl polyether phosphate ester, an alkylaryl polyether phosphate ester, a polycarboxylated ethylene oxide condensate of a fatty alcohol, or mixture thereof. The amine ethoxylates, while providing excellent mold removal, have been found to be incompatible with PET containers.

Sodium alkyl diphenylene oxide disulfonate surfactants are available from Dow Chemical Co. under the tradename of DOWFAX®, such as DOWFAX® C6L.

2. Chelating Agents/Sequestrants

At least one chelating agent/sequestrant is suitably employed in the compositions according to the present invention. Such chelating/sequestering agents include, but are not limited to, phosphates, phosphonates, gluconates, and so forth.

Phosphates suitable for use herein include, but are not limited to, monomers of phosphoric acid, polymers of phosphoric acid, salts of phosphoric acid or combinations thereof; ortho phosphates, meta phosphates, tripolyphosphates, or combinations thereof; phosphoric acid; alkali metal, ammonium and alkanolammonium salts of polyphosphates (e.g. sodium tripolyphosphate and other higher linear and cyclic polyphosphate species, pyrophosphates, and glassy polymeric meta-phosphates); amino phosphates; nitrilotrismethylene phosphates; and the like; or a combination thereof. Preferred phosphates include phosphoric acid, and monomers, polymers, and salts thereof, and the like, or a combination thereof. The concentrate additive composition typically contains about 1 to about 30% by weight phosphate, and suitably about 5 to about 15% by weight.

Suitable phosphonates include a wide variety of phosphonic acids and phosphonate salts, such as organophosphonates. As used herein, organic phosphonate or organophosphonate refers to organic phosphonates lacking any amino or imino (e.g. nitrogen) moieties. The phosphonic acid or phosphonate can include a low molecular weight phosphonocarboxylic acid such as one having about 2–4 carboxylic acid moieties and about –3 phosphonic acid groups. Some examples of organic phosphonates include 1-hydroxyethane-1,1-diphosphonic acid; $CH_3C(OH)[PO(OH)_2]_2$; 1-phosphono-1-methylsuccinic acid, phosphonosuccinic acid; 2-phosphonobutane-1,2,4-tricarboxylic acid; other similar organic phosphonates; and mixtures thereof. Additional suitable phosphonates include phosphorous acid, $H_3PO_3$, and its salts.

As used herein, amino phosphonates refer to phosphonates which have nitrogen moieties, e.g. amino or imino. Examples of amino phosphonates include, but are not limited to ethylene diamine tetramethylene phosphonates; nitrilotrismethylene phosphonates; diethylenetriamine pentamethylene phosphonates; aminotri(methylenephosphonic acid): $N[CH_2PO(OH)_2]_3$; aminotri(methylenephosphonate), sodium salt:

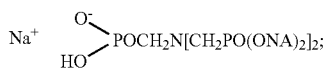

2-hydroxyethyliminobis(methylenephosphonic acid): $HOCH_2CH_2N[CH_2PO(OH)_2]_2$; diethylenetriaminepenta(methylenephoshonic acid): $(HO)_2POCH_2N[CH_2PO(OH)_2]_2]_2$; diethylenetriaminepenta (methylenephosphonate), sodium salt: $C_9H_{(28-x)}N_3Na_xO_{15}P_5$(x=7); hexamethylenediamine(tetramethylenephosphonate), potassium salt: $C_{10}H_{(28-x)}N_2K_xO_{12}P_4$ (x=6); bis(hexmethylene)triamine(pentamethylenephosphonic acid): $(HO_2)POCH_2N[(CH_2)_6N[CH_2]_2]_2$. These amino phosphonates commonly contain alkyl or alkaline groups with less than 8 carbon atoms. Preferred amino phosphonates include, for example, aminotris methylenephosphonic acid: $N[CH_2PO_3H_2]_3$ available from Monsanto Chemical Co. under the tradename of DEQUEST® 2000 and also available as Briquest 301-50A, and Amino Tri(Methylene Phosphonic Acid) 50%, low ammonia from Albright & Wilson; and salts thereof.

Phosphonic acids can be used in the form of water soluble acid salts, particularly the alkali metal salts, such as sodium or potassium; the ammonium salts; or the alkylol amine salts where the alkylol has 2 to 3 carbon atoms, such as mono-, di-, or triethanolamine salts.

Preferred phosphonates include the organic phosphonates. Preferred organic phosphonates include phosphono butane tricarboxylic acid (PBTC) available from Bayer Corp. in Pittsburgh Pa. under the tradename of BAYHIBIT® AM and hydroxy ethylidene diphosphonic acid (HEDP) such as that sold under the tradename of DEQUEST® 2010 available from Monsanto Chemical Co.

Other representative commercially available sequestrants suitable for use herein include, for example, DEQUEST® 3000S available from Monsanto; DEQUEST® 2006, an amino tri(methylene phosphonic acid) pentasodium salt available from Monsanto; ACUSOL® 445 N (Rohm and Haas Co.); ACUSOL® 448 (Rohm and Haas Co.); ACUMER® 2000 (Rohm and Haas Co.); BELSPERSE® 161, phosphino polycarboxylic acid available from Ciba Geigy; sodium gluconate available from Glucona America Inc. and so forth.

Phosphate and phosphonate sequestrants of the type described above are described in commonly assigned copending application attorney docket number 1413US01 and commonly assigned U.S. Pat. No. 6,436,893 both of which are incorporated by reference herein in their entirety.

In some embodiments, the at least one first sequestrant is a phosphonate sequestrant and is employed in combination with at least one second sequestrant which is a phosphate sequestrant, a phosphonate sequestrant or a mixture thereof.

The chelating agents/sequestrants are found to be useful at concentrations of about 1 wt-% to about 40 wt-%, more suitably about 5 wt-% to about 35 wt-%. In some embodiments, it was found to be advantageous to employ a blend of a first phosphonate sequestrant in combination with a second sequestrant which is suitably a phosphate sequestrant, a phosphonate sequestrant or mixture thereof, at a ratio of about 1:15 to about 15:1.

3. Foam Control Agents

Foam control agents are desirably employed in the compositions according to the present invention.

Suitable foam control agents include polyoxypropylene/polyoxyethylene block copolymer surfactants such as PLURONIC® 25R2, PLURONIC® L-61, PLURONIC® L-62 and PLURONIC® L-101 all available from BASF Corp. in Mount Olive, N.J.; GENAPOL® PN-30 from Hoechst/Celanese; and so forth.

Defoamers are typically employed in amounts of about 1 wt-% to about 20 wt-% of the concentrate, and more typically about 2 to about 10 wt-%.

3. Other Adjuvants

Other optional additives may be added to the compositions of the present. Such additives are known to those of skill in the art.

An alkaline compound, typically an alkali metal hydroxide, such as sodium and potassium hydroxide, is employed in the composition for optimum cleaning results. The alkali metal hydroxide is typically employed in amounts of about 5 to about 30 wt-% of the concentrate, and more typically about 10 wt-% to about 25 wt-%.

The concentrate typically will further comprise from about 5 wt-% to about 75 wt-% water, more typically about 25 wt-% to about 75 wt-% water.

The concentrates are diluted prior to use. The concentrates are typically diluted in amounts up to about 0.5:100 to about 2:1000 parts of the concentrate to parts water, and most typically about 1:100 to about 1:300 parts concentrate to parts water.

For some bottlewashing applications, wherein adhesively applied labels are employed, and the labels have been exposed to the sun, the present inventors have found that a concentration of about 0.1 to about 1 wt-% of the concentrate has been advantageously employed, and even more suitably, a concentration of about 0.5 wt-%. In one embodiment, the concentrate was used at a concentration of about 0.55 wt-%. This composition was found to be effective for mold removal and cleaning, and also found to be extremely effective for removing adhesively applied labels, particularly those labels which have been exposed to the sun.

In addition to mold removal and compatibility with PET containers in that corrosion and hazing are not exhibited, the compositions according to the present invention have also been found to reduce the likelihood of stress cracking in PET containers. Stress cracking is a phenomenon that is common in bottlewashing of refillable PET containers.

The present compositions may also find utility in lubricant compositions as well.

The present invention is further illustrated by the following non-limiting examples.

EXAMPLES

Test Methods

1. Mold Remove Ability Test

A) Compositions are prepared according to the following general formula:

| | | |
|---|---|---|
| 1.0% Bottle Wash Additive | 10.0 | g |
| 0.5% $Na_2CO_3$ | 5.0 | g |
| 2.8% NaOH | 28.0 | [or 56 g 50% NaOH and 929 g total water] |
| Tap Water | 957.0 | g |
| Total | 1000.0 | g |

B) Select field returned bottles with heavy mold (black). Select 4 bottles per testing sequence.

C) Cut the mold samples from REF-PET bottles using a utility knife.

D) Label PET/mold pieces to keep track of the source bottle and the solution in which they are tested.

E) Prepare solutions using 2.8% NaOH and 1% of the bottlewashing additive unless otherwise specified.

F) Preheat the solutions to 55° C.

G) Immerse PET/mold samples in respective bottlewashing compositions and soaked for 15 minutes with stirring at 400 rpm.

H) If the mold is removed during testing note the time of removal.

I) Remove the samples from solution. If the mold was not removed, rinse the sample in tap water for 10 seconds to see if mold can be removed at this point.

J) Grade the samples by a % of mold removed and average the 4 tests as well as the time required for removal (Time Removal Grade).

Time Grade is defined as follows:

| Time Grading | |
|---|---|
| Minutes | Grade |
| 1–5 | 95 |
| 6–10 | 90 |
| 11–15 | 85 |
| rinse | 75 |
| not removed | 0 |

Other Grades may be in between or lower depending on total mold removal

2. PET Compatibility

A) Compositions were prepared according to the following formula:

| | | |
|---|---|---|
| 1.0% Bottle Wash Additive | 50.0 | g |
| 0.5% $Na_2CO_3$ | 25.0 | g |
| 2.8% NaOH | 140.0 | [or 280 g of 50% NaOH and 4645 g water] |
| Tap Water | 4785.0.0 | g |
| Total | 5000.0 | g |

B) Stress the bottles by pressurizing with a citric acid and sodium bicarbonate mixture for 24 hours.

C) Release the pressure and rinse well with water.

D) Relax the bottles for 3 days.

E) Immerse the bottles in the bottlewashing solution (2.8% NaOH and bottlewashing additive at specified concentration)

F) Heat the bottles to 55° C. and soak at 55° C. for 24 hours.

G) Remove the bottles from solution and rinse very well with water.

H) Air dry the bottles.

I) The bottles are then graded from 1–10 with 10 being a bottle that looks like it was not tested.

Examples 1–7 and Comparative Examples A–H

A base composition was prepared according to the formula found in the 10 following Table 1:

TABLE 1

| Example 1 | | | Concentration in formula |
|---|---|---|---|
| Sodium gluconate; 100% active | | Glucona America Inc. | 8.34 wt-% |
| BAYHIBIT ® AM | phosphono butane tricarboxylic acid | Bayer | 3.00 |
| DEQUEST ® 2010 | hydroxy ethylidene diphosphonic acid | Monsanto | 18.00 |
| DEQUEST ® 2000 | amino tris methylene phosphonic acid | Monsanto | 15.00 |
| PLURONIC ® 25-R-2 | Polyoxyethylene/ polyoxypropylene block copolymer | BASF | 0.75 |
| WATER | | | 49.91 |
| MOLD REMOVAL SURFACTANT | | | 5.00 |

The following surfactants, found in Table 2, were added to the base composition at a level of 5% and the resultant compositions were tested for cleaning/protecting of polyethylene terephthalate containers according to the test methods described above.

TABLE 2

| | | | |
|---|---|---|---|
| Example 1 | DOWFAX ® C6L | Dow Chemical Co. | $C_6$ alkyl diphenylene oxide disulfonate |
| Comparative A | PETRO ® LBA | Crompton Corp. | Sodium naphthalene sulfonate |
| Example 2 | POLYTERGENT ® CS-1 | BASF | Polycarboxylated ethylene oxide condensates of fatty alcohols |
| Example 3 | DOWFAX ® 8390 | Dow Chemical Co. | $C_{16}$ alkyl diphenylene oxide disulfonate |
| Example 4 | DOWFAX ® 2A1 | Dow Chemical Co. | $C_{12}$ alkyl diphenylene oxide disulfonate |
| Example 5 | Alkamide DC212 S | Rhodia | Coconut diethanolamide |
| Example 6 | SANDOPAN ® DTC Acid | Clariant Corp. | Ether carboxylate |
| Example 7 | AVANEL ® S74 | BASF | sodium linear alkylpolyether sulfonate |
| Comparative C | ETHOX ® 3036 | Ethox Chemicals, LLC | Alkyl phosphate ester |
| Comparative D | SXS | | Sodium xylene sulfonate |
| Comparative E | BEROL ® 260/840 | Akzo Nobel | Alcohol ethoxylates |
| Comparative F | GENAPOL ® PN30 | Clariant Corp. | Ethylene diamine having about 30 moles EO/60 moles PO |
| Comparative G | GENAPOL ® 3520 | Clariant Corp. | Quaternary ammonium compound |
| Comparative H | BK-1057 | Chemax, Inc. | Polyoxyethylene (12) coco amine |

Comparative example B consisted of the base formula without any of the above surfactants added. Comparative example B is not found in Table 2, above.

The results of the testing are summarized in FIG. 1. As can be seen from the Figure, only a few compositions exhibited both excellent cleaning and excellent protection, i.e. non-hazing or non-corroding, of the PET.

Examples 1–4 and 7 exhibited both excellent cleaning, particularly with respect to mold, and excellent compatibility with PET in that no corrosion or hazing were seen on the PET.

Examples 5 and 6 exhibited excellent protection of PET, but did not exhibit excellent mold removal.

The above disclosure is intended for illustrative purposes only and is not exhaustive. The embodiments described therein will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

The invention claimed is:

1. A method of cleaning and protecting polyalkylene terephthalate containers, the method comprising the step of contacting said polyalkylene terephthalate containers with an alkaline composition comprising, the alkaline composition formed by diluting a concentrate, the concentrate comprising about 1% to about 20% of at least one $C_{16}$ to $C_{20}$ alkyl diphenylene oxide disulfonate and mixtures thereof;

about 1% to about 20% of a nonionic defoamer; and about 1% to about 40% of at least one sequestrant selected from the group consisting of phosphonates, gluconates, phosphates and mixtures thereof.

2. The method of claim 1 wherein said alkaline composition comprises at least one first sequestrant which is a phosphonate sequestrant and at least one second sequestrant which is a phosphate sequestrant, a phosphonate sequestrant, a gluconate sequastrant or mixture thereof.

3. The method of claim 2 wherein said alkaline composition comprises at least one first sequestrant which is a phosphonate sequestrant and at least one second sequestrant which is a gluconate sequestrant.

4. The method of claim 1 wherein said $C_{16}$ to $C_{20}$ alkyl diphenylene oxide disulfonate and mixtures thereof is present in said alkaline composition at a concentration of about 0.002 wt-% to about 2 wt-% alter diluting said concentrate.

5. The method of claim 1 wherein said nonionic defoamer is a block copolymer of ethylene oxide and propylene oxide.

6. The method of claim 1 wherein said alkaline composition comprises at least one $C_{16}$ alkyl diphenylene oxide disulfonate.

* * * * *

UNITED STATES PATENT AND TRADEMARK OFFICE

CERTIFICATE OF CORRECTION

PATENT NO. : 7,148,188 B2
APPLICATION NO. : 10/664265
DATED : December 12, 2006
INVENTOR(S) : Michel Lawrence and Gerald Wichmann It is certified that error appears in the above-identified patent and that said Letters Patent is hereby corrected as shown below:

Col. 2 of Title page, line 7,
delete “521/148”,
insert --521/48--

Col. 1, line 33,
delete “consumer”,
insert --consumer.--

Col. 2, line 43,
delete ““A general”,
insert --A general--

Col. 7, line 55,
delete “methylenephoshonic”,
insert --methylenephosphonic--

Col. 10, line 14,
delete “removal”,
insert --removal.--

Col. l0, line 33,
delete “concentration)”,
insert --concentration).--

UNITED STATES PATENT AND TRADEMARK OFFICE

CERTIFICATE OF CORRECTION

PATENT NO. : 7,148,188 B2
APPLICATION NO. : 10/664265
DATED : December 12, 2006
INVENTOR(S) : Michel Lawrence and Gerald Wichmann It is certified that error appears in the above-identified patent and that said Letters Patent is hereby corrected as shown below:

Col. 10, line 44,
delete "in the 10 following",
insert --in the following--

Signed and Sealed this

Twentieth Day of May, 2008

JON W. DUDAS
*Director of the United States Patent and Trademark Office*